US007867044B2

(12) United States Patent
Lee

(10) Patent No.: US 7,867,044 B2
(45) Date of Patent: Jan. 11, 2011

(54) MULTIPLE GROUND TERMINAL ASSEMBLY FOR VEHICLES

(75) Inventor: Ki Yong Lee, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/276,639

(22) Filed: Nov. 24, 2008

(65) Prior Publication Data

US 2009/0156065 A1 Jun. 18, 2009

(30) Foreign Application Priority Data

Dec. 18, 2007 (KR) ..... 10-2007-0133104

(51) Int. Cl.
*H01R 11/11* (2006.01)

(52) U.S. Cl. ..... 439/883; 439/108; 439/781

(58) Field of Classification Search ..... 439/883, 439/287–289, 108, 781
See application file for complete search history.

(56) References Cited

U.S. PATENT DOCUMENTS

| | | | | | |
|---|---|---|---|---|---|
| 4,357,070 | A | * | 11/1982 | Fukushima et al. | 439/883 |
| 5,429,512 | A | * | 7/1995 | Sawamura | 439/883 |
| 5,529,509 | A | * | 6/1996 | Hayes et al. | 439/883 |
| 5,577,927 | A | * | 11/1996 | Okada et al. | 439/907 |
| 5,586,899 | A | * | 12/1996 | Okada | 439/287 |
| 5,759,055 | A | * | 6/1998 | Colantuano et al. | 439/883 |
| 5,834,696 | A | * | 11/1998 | Kurosawa et al. | 439/288 |
| 5,865,638 | A | * | 2/1999 | Trafton | 439/927 |
| 5,934,923 | A | * | 8/1999 | Matsuoka et al. | 439/883 |
| 7,125,295 | B2 | * | 10/2006 | Zhao et al. | 439/883 |

* cited by examiner

*Primary Examiner*—Briggitte R Hammond
(74) *Attorney, Agent, or Firm*—Edwards Angell Palmer & Dodge LLP; Peter F. Corless

(57) ABSTRACT

Disclosed herein is a multiple ground terminal assembly for vehicles. The multiple ground terminal assembly includes a multiple ground terminal unit 100 and a ground bolt 200, and can be formed by layering multiple ground terminals 110 to be in surface contact with each other.

8 Claims, 8 Drawing Sheets

MULTIPLE GROUND TERMINAL ASSEMBLY FOR VEHICLES

CROSS-REFERENCE TO RELATED APPLICATIONS

This application claims under 35 U.S.C. §119(a) priority to Korean Application No. 10-2007-0133104, filed on Dec. 18, 2007, the disclosure of which is incorporated herein by reference in its entirety.

BACKGROUND OF THE INVENTION

1. Field of the Invention

The present invention relates generally to a multiple ground terminal assembly for vehicles and, more particularly, to a multiple ground terminal assembly for vehicles, in which a second ground part is additionally formed inside a ring-shaped first ground part so as to come into contact with a ground bolt, thus improving conductivity.

2. Background Art

FIG. 1A is a view showing a typical ground terminal assembly 1 for vehicles.

As shown in FIG. 1B, the ground terminal 11 of the ground terminal assembly 1 preferably includes a ring-shaped first ground part 11*a*, the center portion of which is perforated. Hooks 11*b* and 11*c* are formed to be bent inwards at the outer circumferential surface of the first ground part 11*a* and to preferably face each other. The above-described hooks 11*b* and 11*c* function to suitably connect the ground terminal 11 to another ground terminal.

As shown in FIG. 1C, the ground terminal unit 10 of the ground terminal assembly 1 is formed by layering a plurality of ground terminals 11, each having a ring-shaped first ground part 11*a*, so that they are in surface contact with each other. The ground terminal unit 10, which is formed by layering the ground terminals 11, the central portions of which are perforated, are fastened to a vehicle body 30 using a ground bolt. The ground terminal, which is located at the uppermost end of the ground terminal unit 10, is locked to the head part 21 of the ground bolt. A body 22, which extends from the above-described head part 21, passes through the central perforated portion to thus fasten the ground terminal unit 10 to the vehicle body 30.

The flow of current in the conventional ground terminal assembly for vehicles is described with reference to FIG. 2 below.

The current, which is supplied by a battery 40, flows through each of the ground terminals 11, which are layered and thus in surface contact with each other, by which the ground terminal unit 10 is formed. The ground terminals 11 are in surface contact with each other, so that the supplied current can be transmitted to the head part 21 of the ground bolt via the ground terminals 11 even though the ground terminals 11 are not in direct contact with the head part 21 of the ground bolt. The current that is applied to the head part 21 flows to the vehicle body 30 via the body 22 of the ground bolt.

In the conventional ground terminal assembly for vehicles, for example as described above, the conductivity of the ground terminal unit 10 is lowered when foreign materials are caught then accumulate between the ground terminals 11, which are layered to be in surface contact with each other, due to the continuous use thereof and, accordingly, non-conducting material layers from the foreign materials the are caught and accumulated are formed therebetween.

The above information disclosed in this the Background section is only for enhancement of understanding of the background of the invention and therefore it may contain information that does not form the prior art that is already known in this country to a person of ordinary skill in the art.

SUMMARY OF THE INVENTION

The present invention preferably provides a multiple ground terminal assembly for vehicles, in which a second ground part is preferably formed inside a ring-shaped first ground part, thus suitably improving conductivity.

In preferred embodiments, the present invention provides a multiple ground terminal assembly for vehicles, preferably including a multiple ground terminal unit formed by suitably layering multiple ground terminals to be in surface contact with each other, where each of the multiple ground terminals preferably comprises a substantially ring-shaped first ground part, the central portion of which is preferably perforated, and a second ground part, which preferably extends from the inner portion of the first ground part; and a ground bolt preferably comprising a head part, which is suitably locked to the uppermost multiple ground terminal of the multiple ground terminal unit, and a body, which is preferably configured to extend from the head part in the direction of the lowermost multiple ground terminal and to be in suitable contact with the second ground parts of the multiple ground terminals.

In certain preferred embodiments, the second ground part may extend vertically from the first ground part.

In other preferred embodiments, the heights of the second ground parts of the respective multiple ground terminals, which suitably constitute the multiple ground terminal unit, may be sequentially decreased, preferably in a direction from the lowermost second ground part to the uppermost second ground part.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and advantages of the present invention will be more clearly understood from the following detailed description taken in conjunction with the accompanying drawings, which are given hereinafter by way of illustration only, and thus are not limitative of the present invention, and wherein.

DESCRIPTION

As described herein, the invention features a multiple ground terminal assembly for vehicles, preferably comprising a multiple ground terminal unit; and a ground bolt comprises a head part and a body.

In one preferred embodiment the multiple ground terminal unit is preferably formed by layering multiple ground terminals to be in surface contact with each other, each of the multiple ground terminals comprising a substantially ring-shaped first ground part, a central portion of which is preferably perforated, and a second ground part.

In another embodiment of the invention as described herein, the second ground part preferably extends from an inner portion of the first ground part.

In a further embodiment, the second ground part extends vertically from the first ground part.

In another preferred embodiment of the invention, the multiple ground terminal assembly as described in the aspects herein, further comprises suitably decreasing the heights of the second ground parts of the respective multiple ground terminals preferably in a direction from the lowermost second ground part to the uppermost second ground part.

In one embodiment, the ground bolt comprising a head part is locked to the uppermost multiple ground terminal of the multiple ground terminal unit.

In another embodiment, the body is suitably configured to extend from the head part in a direction of the lowermost multiple ground terminal and to be in contact with the second ground parts of the multiple ground terminals.

As described herein, the present invention also includes a motor vehicle comprising the multiple ground terminal assembly of the aspects as described herein.

Preferred embodiments of a multiple ground terminal assembly for vehicles according to the present invention are described in detail with reference to the accompanying drawings below.

Figure 1A:
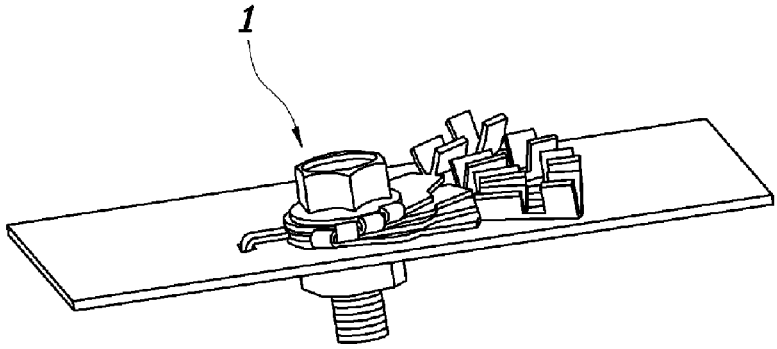
FIG. 1A (Prior Art)
FIG. 1A is a view showing a typical ground terminal assembly for vehicles.
Figure 1B:
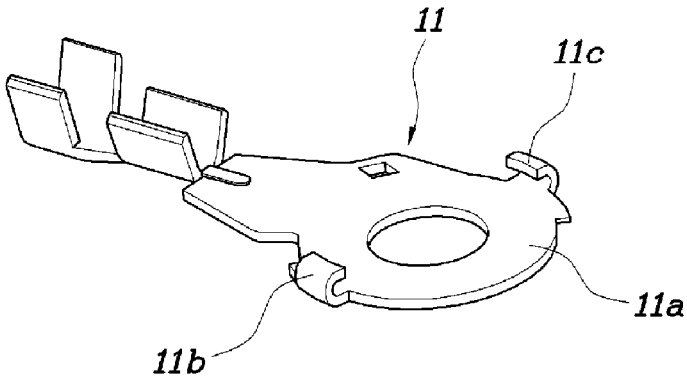
FIG. 1B (Prior Art)
FIG. 1B is a sectional view of a conventional ground terminal assembly for vehicles, which is coupled using a ground bolt.
Figure 1C:
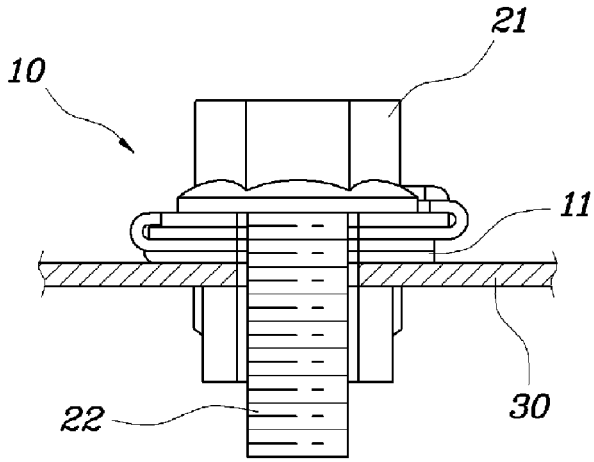
FIG. 1C (Prior Art)
FIG. 1C is a perspective view of a ground terminal, which constitutes the conventional ground terminal assembly for vehicles.
Figure 2:
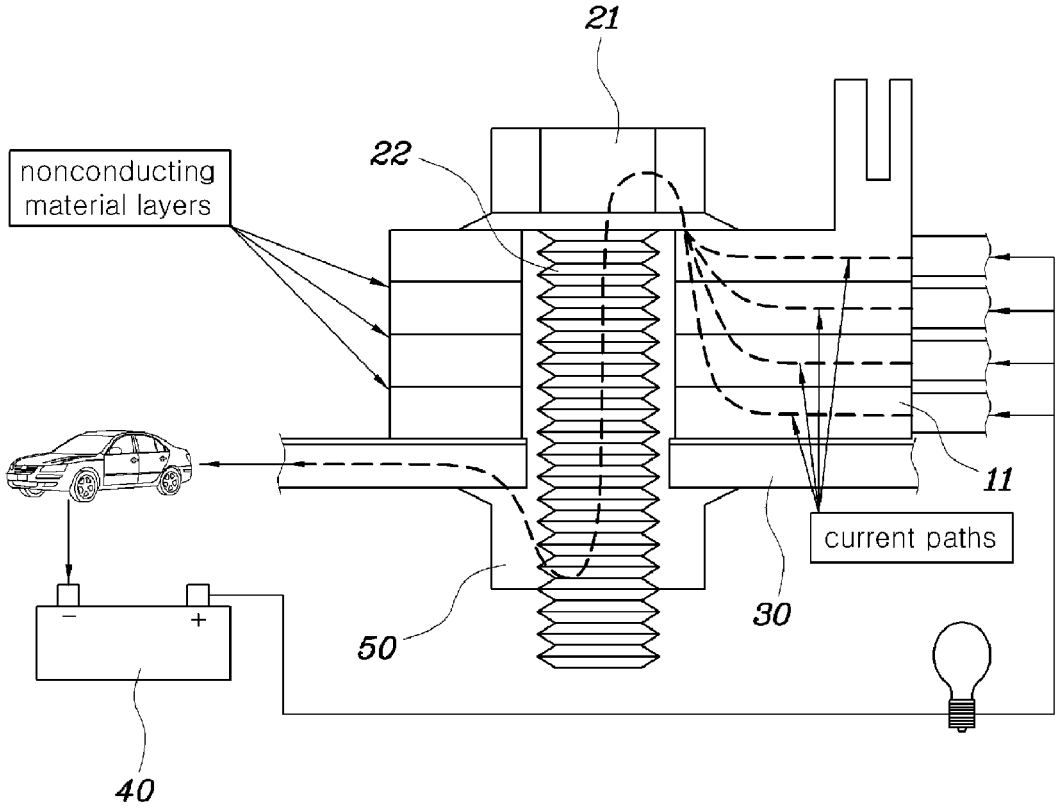
FIG. 2 (Prior Art)
FIG. 2 is a view showing the flow of current in the conventional ground terminal assembly for vehicles.
Figure 3:
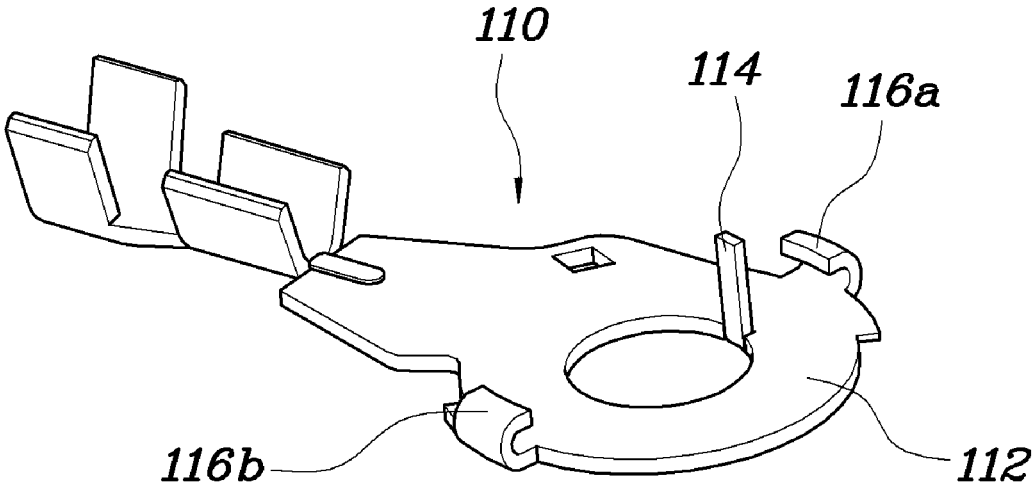
FIG. 3 is a perspective view of a ground terminal, which constitutes a multiple ground terminal assembly for vehicles according to the present invention.

In preferred embodiments of the invention as described herein, and as shown in FIG. 3, each of the multiple ground terminals 110 preferably includes a substantially ring-shaped first ground part 112, the central portion of which is preferably perforated, and, preferably, a second ground part 114, which extends from the inner portion of the first ground part 112. In further preferred embodiments, hooks 116*a* and 116*b* are formed on the outer circumferential surface of the multiple ground terminal 110 that the multiple ground terminals 110 can be suitably coupled to each other.

Figure 4A:
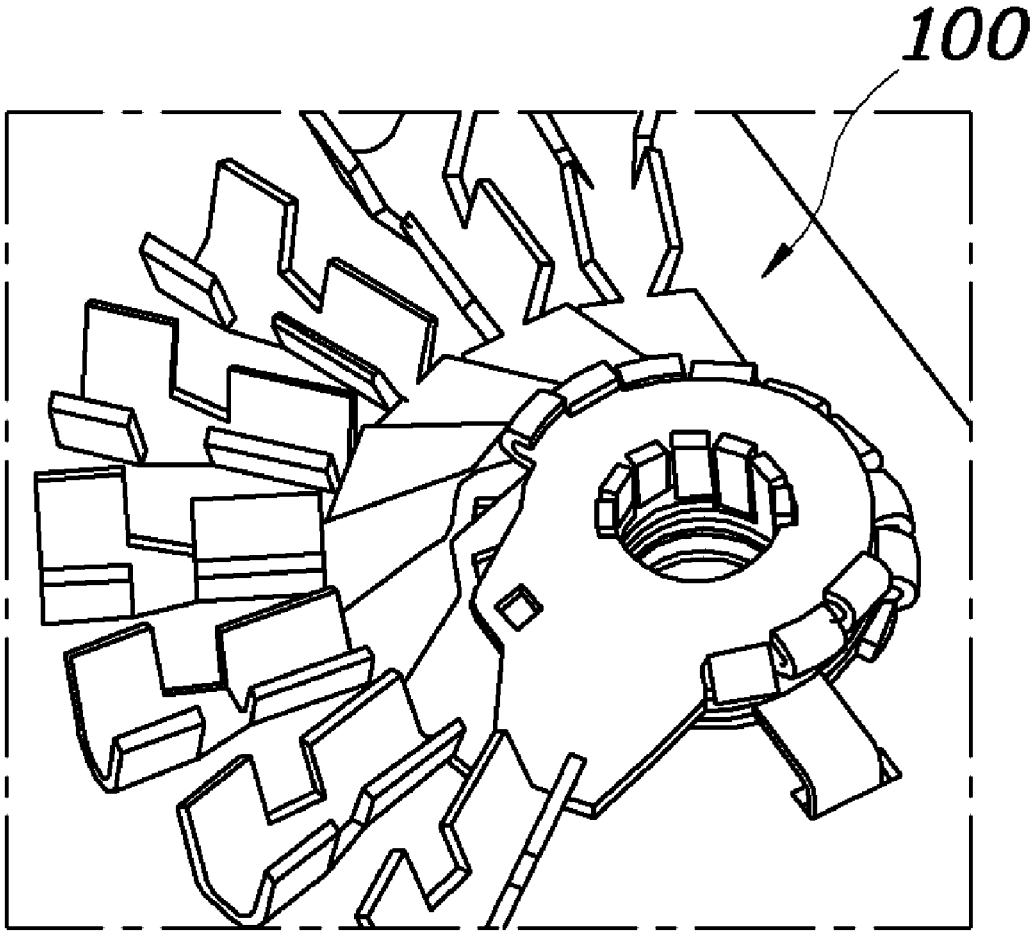
FIG. 4A is a schematic view showing the outward appearance of the multiple ground terminal assembly for vehicles before the multiple ground terminal assembly for vehicles according to the present invention is coupled using a ground bolt.
Figure 4B:
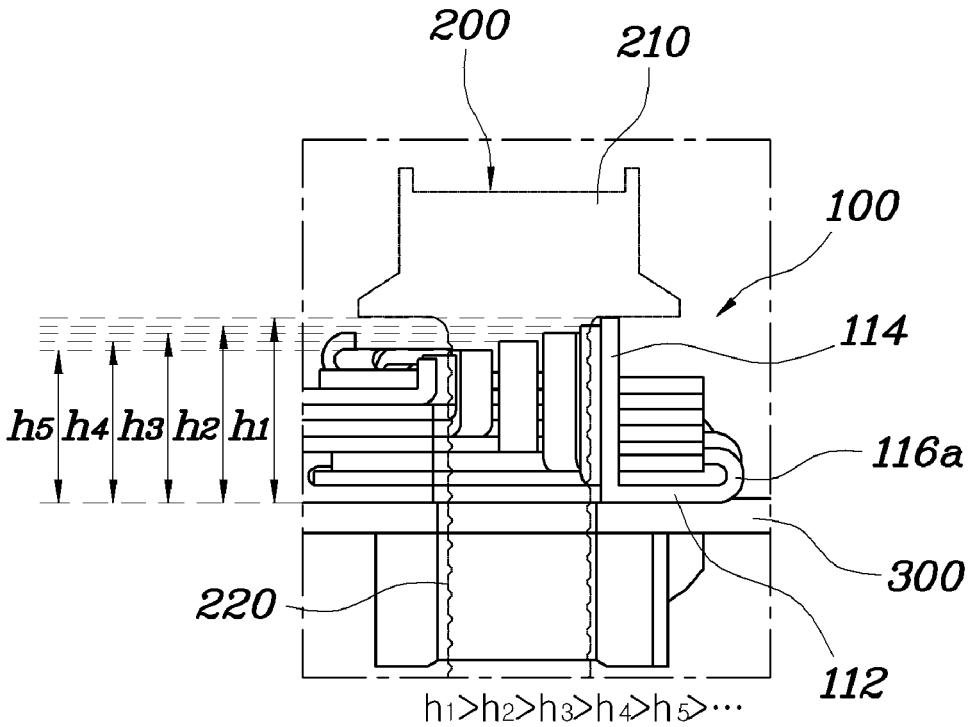
FIG. 4B is a sectional view of the multiple ground terminal assembly for vehicles before the multiple ground terminal assembly for vehicles according to the present invention is coupled using the ground bolt.

As shown in FIGS. 4A and 4B, a multiple ground terminal unit 100 is preferably formed by suitably layering the multiple ground terminals 110, preferably so that they face each other and are in surface contact with each other. IN further embodiments, the multiple ground terminals 110 are suitably coupled to each other using the hooks 116*a* and 116*b*, which are bent from the first ground parts 112. Preferably, each of the multiple ground terminals 110 has a second ground part 114, which extends from the inner portion of the first ground part 112. Preferanbly, the above-described multiple ground terminal unit 100 is suitably fastened to a vehicle body 300 using a ground bolt 200, which is provided with a head part 210 and a body 220. In other preferred embodiments, before the ground bolt 200 is tightened, the second ground parts 114 are not in contact with the body 220 of the ground bolt 200.

Figure 5A:
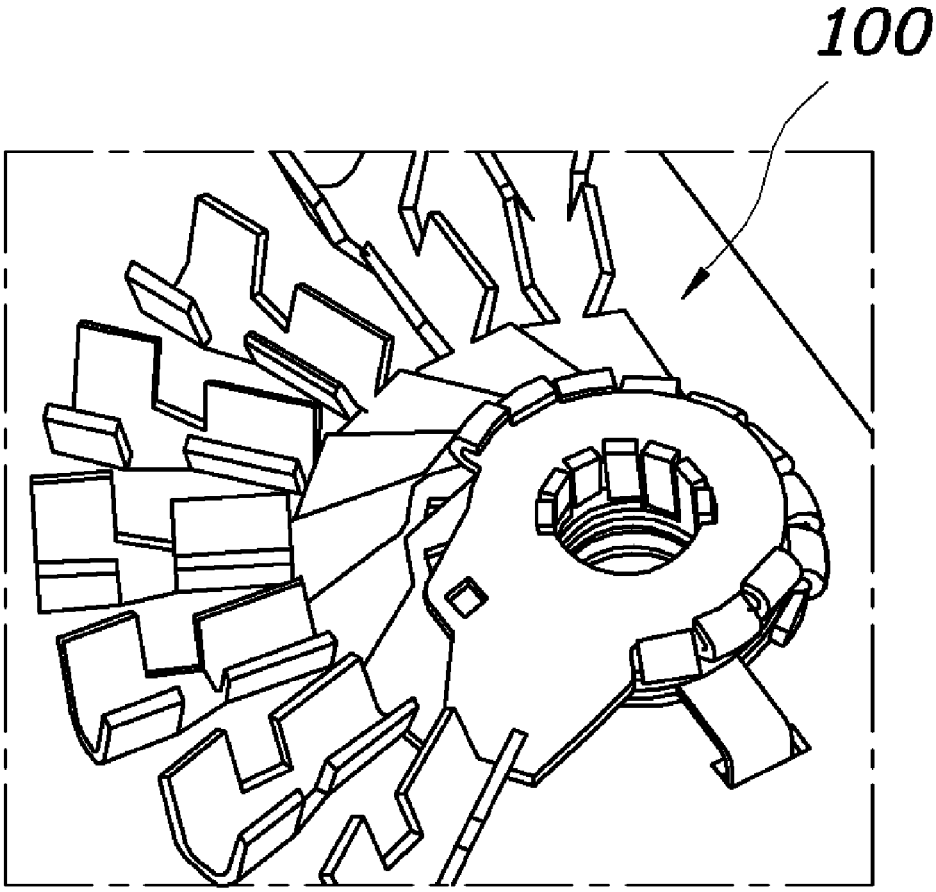
FIG. 5A is a schematic view showing the outward appearance of the multiple ground terminal assembly for vehicles after the multiple ground terminal assembly for vehicles according to the present invention is coupled using the ground bolt.
Figure 5B:
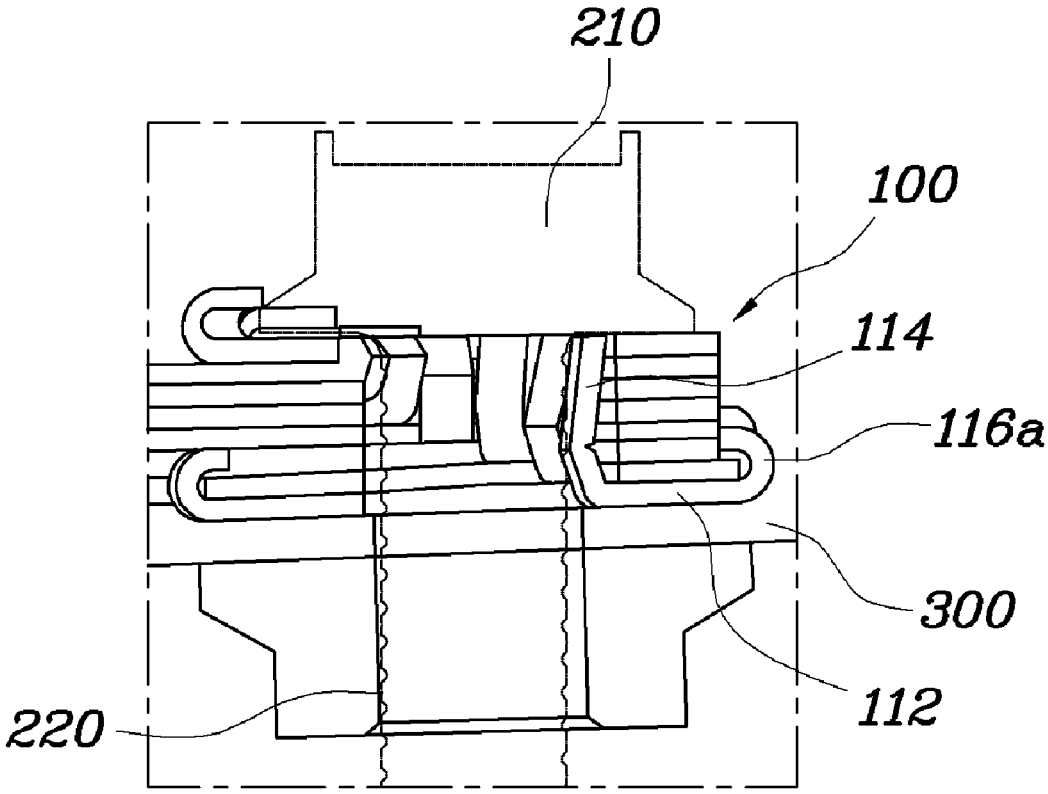
FIG. 5B is a sectional view of the multiple ground terminal assembly for vehicles after the multiple ground terminal assembly for vehicles according to the present invention is coupled using the ground bolt.

As shown in FIGS. 5A and 5B, the above-described multiple ground terminal unit 100, which is formed by layering the multiple ground terminals 110, having respective ring-shaped first ground parts 112, the central portions of which are perforated, is preferably fastened to the vehicle body 300 using the ground bolt 200. Preferably, when the ground bolt 200 is tightened, the head part 210 of the ground bolt 200 is suitably locked to the first ground part 112 of the multiple ground terminal, which is located at the uppermost end of the multiple ground terminal units 100. In other further embodiments, the second ground parts 114, which preferably extend from the respective inner portions of the first ground parts 112, are preferably formed vertically from the respective first ground parts 112, so that they are suitably pressed by the head part 210 of the ground bolt 200 and are thus suitably bent in the direction of the body 220.

Accordingly, the conductivity of the multiple ground terminals 110 can be improved because the second ground parts 114 are in contact with the body 220 of the ground bolt 200 even when the multiple ground terminals 110, which are located in the lower end of the multiple ground terminal unit 100, are not in direct contact with the head part 210 of the ground bolt 200. Preferably, the flowing current can flow through the first ground parts 112 and the head part 210 of the ground bolt 200, and also through the second ground parts 114 and the body 220, which are distinct paths.

In other embodiments, the second ground parts 114 of the multiple ground terminals 110 may extend vertically from the respective inner portions of the first ground part 112.

s As described herein, when the ground bolt 200 is suitably tightened, the second ground parts 114 are pressed by the lower end of the head part 210 of the ground bolt 200. Accordingly, the second ground parts 114 can be bent in the direction of the body 220 of the ground bolt 200 and thus be easily brought into contact with the body 220.

In other further embodiments, it is preferred that the heights of the respective multiple ground terminals 110, which constitute the multiple ground terminal unit 100, be suitably sequentially decreased in the direction from the lowermost second ground part to the uppermost second ground part. Preferably, when the ground bolt is suitably tightened, the second ground parts 114 of the respective multiple ground terminals 110 are sequentially bent in the direction of the body 220 of the ground bolt 200, and thus the force that is generated by tightening the ground bolt 200 can be uniformly distributed to the multiple ground terminals 110.

Figure 6:
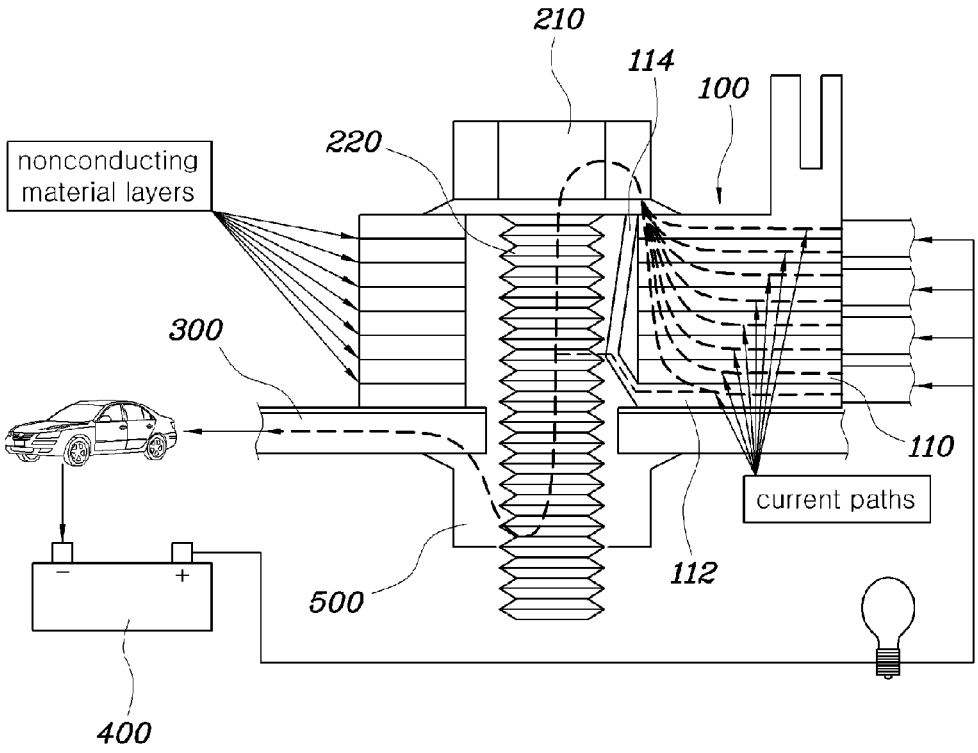
FIG. 6 is a view showing the flow of current in the multiple ground terminal assembly for vehicles according to the present invention.

The flow of current in the multiple ground terminal assembly for vehicles according to the present invention is described with reference to FIG. 6 below.

In further preferred embodiments, the current, which is preferably supplied by the battery 400, flows through the multiple ground terminals 110, which constitute the multiple ground terminal unit 100. Preferably, the supplied current may flow to the head part 210 of the ground bolt 200 via the first ground parts 112 of the respective multiple ground terminals 110, and then may flow to the vehicle body 300 via the body 220 and a nut 500. Preferably, because the second ground parts 114 of the respective multiple ground terminals 110 are in contact with the body 220 of the ground bolt 200, the supplied current may flow directly to the body 220, rather than flowing to the head part 210 of the ground bolt.

Accordingly, the multiple ground terminals 110, which are preferably located at the lowermost end of the ground bolt 200, can cause the supplied current to be applied to the body 220 of the ground bolt 200, so that the supplied current can flow uninterruptedly even when nonconducting material layers made of foreign materials form between the multiple ground terminals 110. Furthermore, the current suitably flow through two paths, and thus the conductivity of the multiple ground terminals 110 can be improved.

Although the preferred embodiments of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A multiple ground terminal assembly for vehicles, comprising:

a multiple ground terminal unit formed by layering multiple ground terminals to be in surface contact with each other, each of the multiple ground terminals comprising a ring-shaped first ground part, a central portion of which is perforated, and a second ground part, which extends from an inner portion of the first ground part;

a ground bolt comprising a head part, which is locked to the uppermost multiple ground terminal of the multiple ground terminal unit, and a body, which is configured to extend from the head part in a direction of the lowermost multiple ground terminal and to be in contact with the second ground parts of the multiple ground terminal; and wherein, when the multiple ground terminal unit is bolted by the ground bolt, each of the second ground parts is pressed in a vertical direction by the head part of the ground bolt so that each of the second ground parts can be bent toward the body of the ground bolt to become in contact with the body of the ground bolt to make a current path, thereby providing a current path.

2. The multiple ground terminal assembly as set forth in claim 1, wherein the second ground part extends vertically from the first ground part.

3. The multiple ground terminal assembly as set forth in claim 2, wherein the multiple ground terminals are layered such that heights of the second ground parts of the respective multiple ground terminals, which constitute the multiple ground terminal unit, are sequentially decreased in a direction from the lowermost second ground part to the uppermost second ground part.

4. A multiple ground terminal assembly for vehicles, comprising:

a multiple ground terminal unit formed by layering multiple ground terminals to be in surface contact with each other, each of the multiple ground terminals comprising a ring-shaped first ground part, a central portion of which is perforated, and a second ground part, which extends from an inner portion of the first ground part;

a ground bolt comprises which comprises a head part and a body and is configured to be able to bolt the multiple ground terminal units; and wherein, when the multiple ground terminal unit is bolted by the ground bolt, each of the second ground parts is pressed in a vertical direction by the head part of the ground bolt so that each of the second ground parts can be bent toward the body of the ground bolt to become in contact with the body of the ground bolt to make a current path, thereby providing a current path.

5. The multiple ground terminal assembly of claim 4, wherein the second ground part extends vertically from the first ground part.

6. The multiple ground terminal assembly of claim 4, further comprising decreasing the wherein the multiple ground terminals are layered such that heights of the second ground parts of the respective multiple ground terminals are sequentially decreased in a direction from the lowermost second ground part to the uppermost second ground part.

7. The multiple ground terminal assembly for vehicles of claim 4, wherein the head part of the ground bolt comprising a head part is locked to the uppermost multiple ground terminal of the multiple ground terminal unit.

8. The multiple ground terminal assembly for vehicles of claim 4, wherein the body of the ground bolt is configured to extend from the head part in a direction of the lowermost multiple ground terminal and to be in contact with the second ground parts of the multiple ground terminals.

* * * * *